United States Patent [19]

Liesting

[11] 4,048,494

[45] Sept. 13, 1977

[54] DEVICE FOR TAKING PIECES OF MATERIAL STUCK TO A SUBSTRATE WOUND ON A REEL

[76] Inventor: Bernardus G. Liesting, Aalsburg 1214, Wijchen, Netherlands

[21] Appl. No.: 640,208

[22] Filed: Dec. 12, 1975

[51] Int. Cl.[2] ..... B65C 9/42

[52] U.S. Cl. ..... 250/223 R; 156/DIG. 45; 250/578; 221/73; 226/24

[58] Field of Search ..... 250/223 R, 571, 224, 250/578; 198/20 R, 21; 156/DIG. 33, DIG. 45

[56] References Cited

U.S. PATENT DOCUMENTS

| | | | |
|---|---|---|---|
| 3,171,621 | 3/1965 | Steinbach et al. | 250/223 R |
| 3,260,851 | 7/1966 | Jacobsson | 250/223 R |

FOREIGN PATENT DOCUMENTS

| | | | |
|---|---|---|---|
| 1,136,261 | 12/1968 | United Kingdom | 250/223 |

*Primary Examiner*—Eugene R. LaRoche
*Attorney, Agent, or Firm*—Cushman, Darby & Cushman

[57] ABSTRACT

A device for removing adhesive labels or the like from a substrate in which a reel of the substrate material is rotatably mounted about an axis in a trough of a housing which also includes a horizontal guide supporting the substrate above the axis. The guide has a bending edge which separates label and substrate. The substrate is driven by rollers mounted below the axis and operated by a motor. A light source and photocell are disposed adjacent the bending edge for disabling the motor when a label is located therebetween.

18 Claims, 11 Drawing Figures

DEVICE FOR TAKING PIECES OF MATERIAL STUCK TO A SUBSTRATE WOUND ON A REEL

The invention relates to a device for picking up pieces of material such as adhesive plates or the like stuck to a substrate wound on a reel.

Prior art devices of the kind set forth involve the disadvantage that the displacement of the support cannot be performed so that each time only one piece of material is removed from the support without loosening at least partly a subsequent piece of material from the support, because for example the distance between the pieces of material varies.

The invention has for its object to provide a device of the kind set forth, which can be controlled in a simple manner and in which it is ensured that upon actuation of the device only one piece of material is removed from the substrate at one time.

According to the invention this can be achieved by providing a driving member for driving the support, a control-member for the driving member and a photo-electric scanner for scanning the pieces of material, the driving member being controlled so that it is disabled after a piece of material is detached from the substrate.

With the device embodying the invention it is only necessary, in order to pick up a piece of material from the substrate, to start the driving member, the substrate being then displaced over a distance such that only one piece of material is released from the substrate without other pieces of material being partly loosened. Subsequently the driving member stops and the device is ready for a further removal of a piece of material from the substrate.

The device according to the invention may be designed so that the driving member is started by means of a control-member actuated by means of a push-button. When the portion of the substrate located between the adhesive tickets travels past the photo-electric scanner and electric pulse is produced at the output of the pick-up element of the photo-electric scanner for switching off the control-member and hence the driving member. The electric pulse appears at the output of the pick-up element of the photo-electric scanner owing to the difference between the optical properties of the substrate and of the pieces of material such as adhesive labels and the like.

The driving member is virtually stopped at the appearance of a difference between the optical proporties of the combination formed by the substrate and the pieces of material to be picked up in accordance with the invention at the transition from opaque material to light-pervious material.

If the pieces of material to be picked up, for example, adhesive labels, are printed, an electric pulse will be produced by the pick-up element of the photo-electric scanner at the passage of the piece of material to be removed along the photo-electric scanner, which pulse may stop the driving member.

In order to solve this problem the invention proposes furthermore to provide the control-member with an amplifier controlled by the photo-electric scanner, said amplifier being adjusted so that at a decrease in the quantity of light incident to the pick-up element of the photo-electric scanner during the passage of the piece of material to be removed along the scanner the output signal of the amplifier is not varied.

Hereinafter the device embodying the invention will be described in further detail with reference to the drawings.

Figure 1:
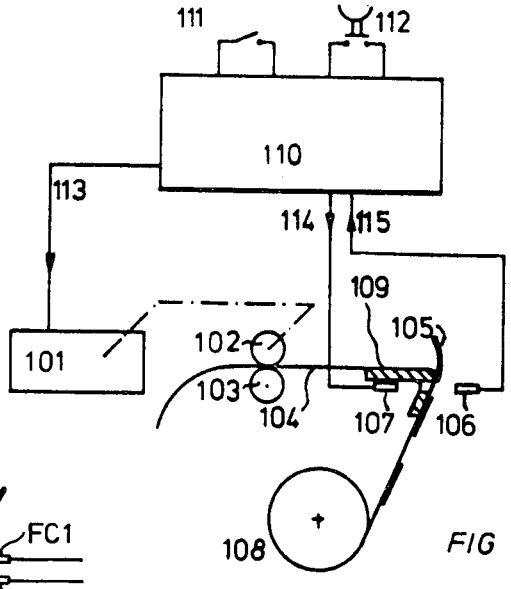
FIG. 1 illustrates the principle of the device in accordance with the invention.

Referring to FIG. 1 a supply reel 108 carries a substrate 104 with pieces of material such as adhesive labels of the like 105. The substrate 104 with the adhesive labels 105 stuck thereto is guided past a photo-electric scanner formed by a photo-electric cell 106 and a light source 107. The substrate may be such that its transparency exceeds that of the adhesive labels 105. The substrate with the adhesive labels is passed along a bending edge 109 so that owing to the sharp curvature of the edge 109 the adhesive labels are released from the substrate. The substrate is driven by a motor 101 coupled with a set of driving rollers 102 and 103 for the substrate 104. It should be noted that the drive of the substrate, the manner of releasing the adhesive labels, the supply reel, the disposition of the photo-electric cell 106 and the light source 107 are only indicated schematically.

The motor 101 is controlled through the line 113 by a control-member 110. The control member receives input signals from the switch 111, the push-button 112 and via the line 115 from the photo-electric cell 106. The control-member 110 has an output line 114 through which the light source 107 is controlled. The device according to the invention operates in a manner such that after the push-button 112 is depressed and released, the control-member 110 applies an enabling signal via the line 113 to the motor, whilst the light source 107 is ignited through the line 114. The motor 101 then moves the substrate 104 with the aid of driving rollers 102 and 103 until the edge of an adhesive label 105 appears between the light source 107 and the photo-electric cell 106 so that via the line 115 a signal is applied to the control-member disabling the energizing signal through the line 113 so that the motor is stopped. Moreover, at this instant the light source 107 is switched off through the line 114 by the control-member 110. Then the device is ready for a next cycle of operation. The control-member has a further switch 111, which permits of putting the device completely out of operation, for example, when the supply reel 108 is exhausted.

Figure 2:
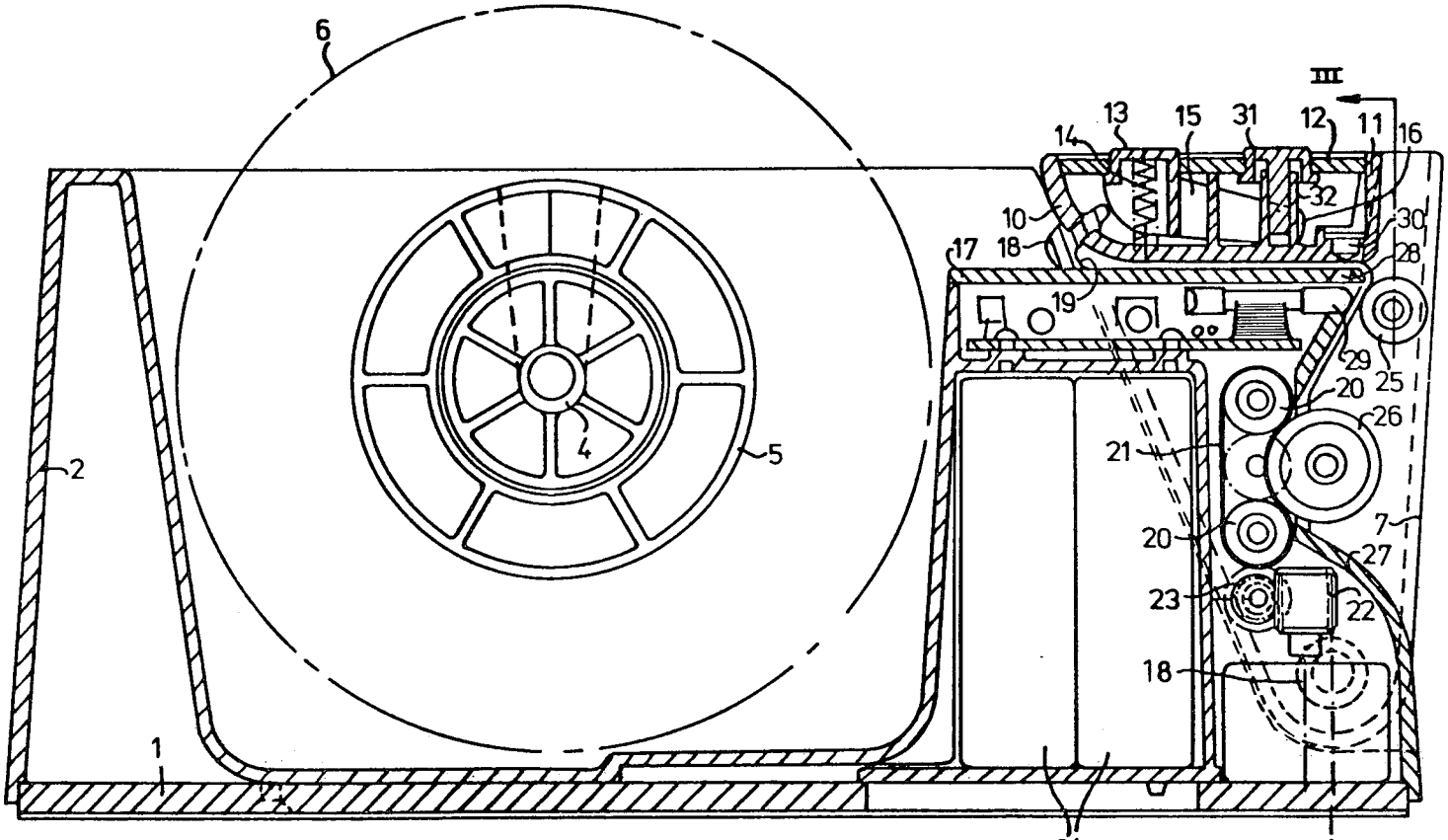
FIG. 2A and 2B are a sectional view of an embodiment of a device in accordance with the invention.
Figure 3:
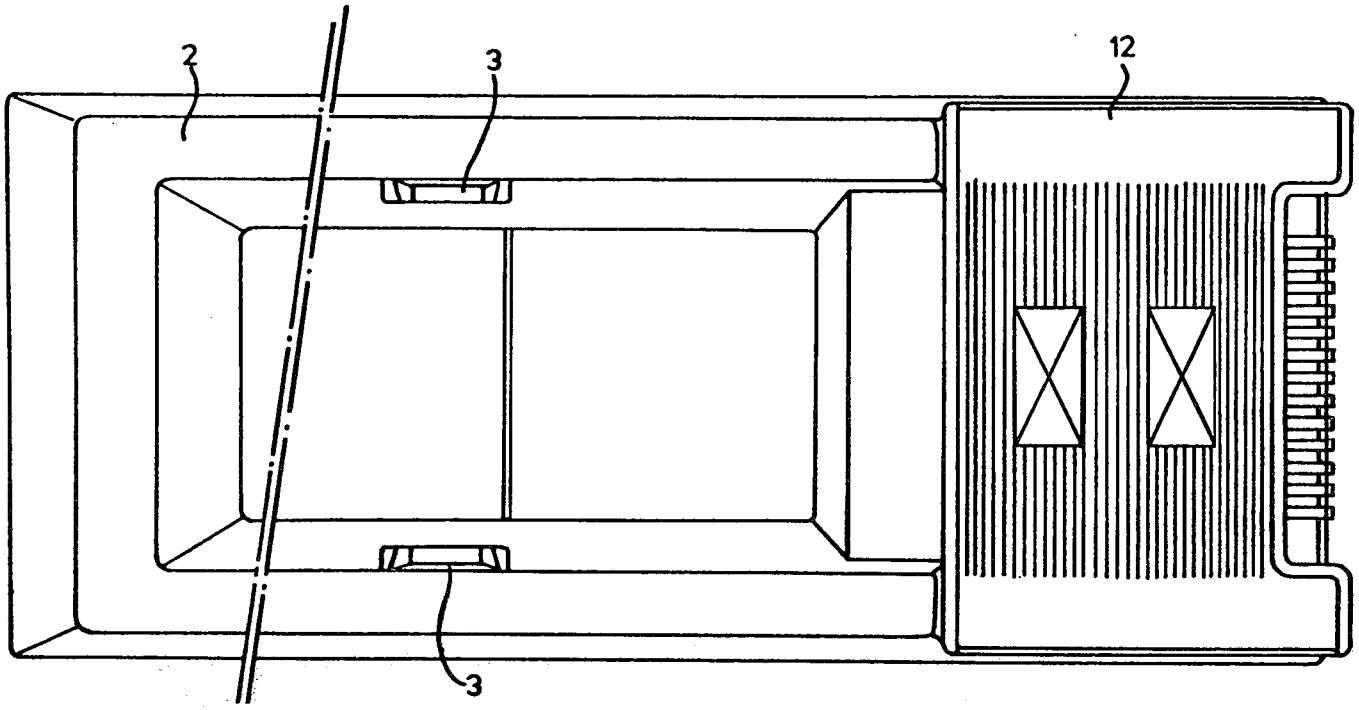
FIG. 3 is a plan view of the device shown in FIG. 2, the reel being omitted.
Figure 4:
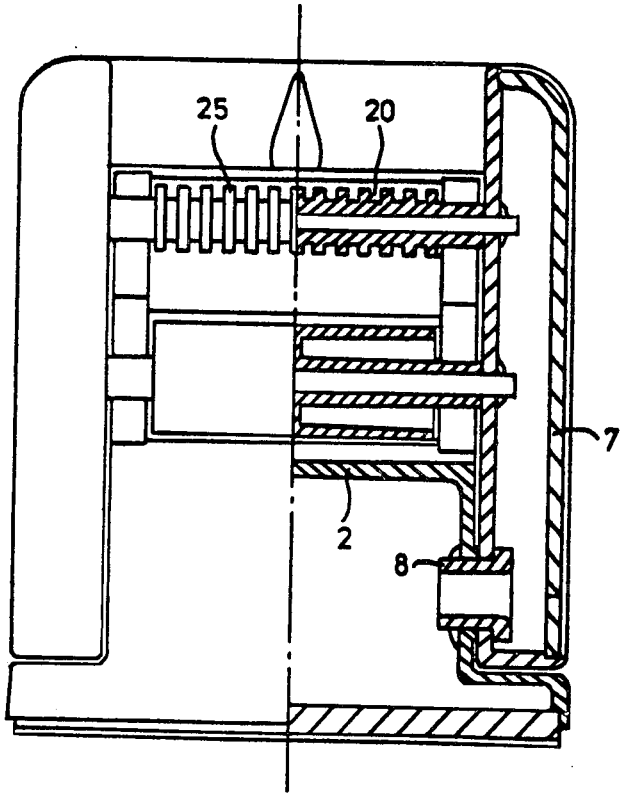
FIG. 4 is partly an elevation of the right-hand end of the device shown in FIG. 1 and partly a sectional view taken on the line III—III in FIG. 2.

The device shown in the FIGS. 2A, 3 and 4 comprises a base plate 1, to which is fastened a trough-shaped housing 2 having at least partly double walls. Opposite inner walls of the trough-shaped housing 2 have recesses 3 for accommodating the ends of a shaft 4, which forms part of a reel 5. The reel has wound on it a strip-shaped substrate 6 to which are stuck pieces of material such as adhesive labels or so-called stickers.

At one end of the housing 2 a lid 7 is pivotally arranged by means of pivotal sleeves 8. Between two opposite side parts of the lid 7 a horizontal plate 9 is arranged, whose end 10 facing the reel 5 is bent over upwardly. The rear end of the plate 9 is joined by an upwardly extending plate 11 and the space formed by the plates 9, 10 and 11 is closed by a lid 12. The lid 12 has an opening holding a push-button 13, which can be depressed against the action of a spring 14. To the push-button 13 are fastened two arms 15, the hook-like ends 16 of which are located in the position shown in the Figure, in recesses in a plate 17 extending beneath and parallel to the plate 9 and rigidly secured to the housing 2. In this way the lid 7 is locked against rotation about the pivotal sleeves, 8.

The figures show furthermore that the plate 9 has secured to it a strip 18 of flexible material, a tag 19 which is in contact with the top side of plate 17 in the position shown.

Beneath the plate 17 the housing 2 accomodates two rollers 20 located one above the other and adapted to rotate about horizontal rotary shafts, a belt or rope 21 being passed along said rollers, the width of said belt or rope being preferably at least substantially equal to the width of the substrate 6. The rollers 20 can be driven by means of a motor 22 arranged in the housing 2 through a transmission mechanism 23. The motor 22 may be fed from batteries arranged in said housing.

The lid 7 holds a roller 25 adapted to rotate about a horizontal shaft and having in is periphery grooves 26 surrounding the rotary shaft. From FIG. 2A it will be apparent that the roller is located at the level of the end of the plate 17 remote from the reel 5. At a given distance beneath the roller 25 a roller 26 of larger diameter is journalled in the lid, said roller being disposed so that the portion of the belt 21 located between the rollers is slightly compressed. Beneath the roller 26, between the sidewalls of the lid 7 a curved wall portion 27 of the housing is arranged.

Near the end of the plate 17 remote from the reel 5 a hole 28 is provided in the plate 17, beneath which hole is located a lamp 29 mounted in the housing. Above the hole 28 the plate 9 has a recess in which is mounted a photo-electric cell 30.

The lid 12 has a further opening holding a push-button 31, which is guided by arms 32 secured to the plate 9. The push-button 31 is connected in a manner not shown with the electric circuitry of the motor 22 and the lamp 29.

When the button 13 is depressed, it will turn with respect to the lid 7 so that the hook-like ends of the arms 15 are moved out of the recesses in the plate 17, after which the lid 7 can be turned, viewed in FIG. 2 in clockwise direction with respect to the housing 1. This movement initiated by the tension in the belt 21 which tends to push the roller 26 away. The end of the substrate can be guided along the plate 17 and down along the plate 27. By turning subsequently the lid 7 back into the position shown in FIG. 2 the end of the substrate 6 is clamped between the roller 26 and the belt 21, the substrate being bent over along the end of the plate 17 remote from the reel 5. When the button 31 is then depressed, the motor 22 is energized, so that it will drive the two rollers 20, the substrate of transparent material being thus displaced in its direction of length by the belt 21. A piece of material adhering to the substrate will thus move together with the substrate past between the two plates 9 and 17. At the end of the plate remote from the real 5 the substrate is bent over through a comparatively acute angle. The piece of material adhering to the substrate, for example, a sticker or the like, will not follow this bend of the substrate, but it will move on approximately along a substantially straight line so that the piece of material will bear on the roller 25, from which it can be taken by the user. As long as the piece of material moves past between the opening 28 and the photo-electric scanner 30, this photo-electric cell will not receive light from the lamp 29. However, as soon as the piece of material has passed beyond the photo-electric cell, the latter will receive light from the lamp 29 so that a signal is produced, which disables motor 22 and the device is stopped. It is thus ensured that independently of the size of the interstices between the pieces of material stuck to the substrate 6, which are usually not accurately defined, and/or independently of the length of the pieces of material, viewed in the direction of movement of the substrate, the drive of the substrate is switched off after the passage of one piece of material so that every time only one piece of material is released from the substrate.

Since the substrate is passed between the plate 17 and the tag 19 resiliently bearing on said plate, the substrate is prevented from moving backwards, when the device is standing still. The substrate is furthermore clamped between the belt 21 and the roller 26 so that the portion of the substrate between the tag 19 and the roller 26 is always kept taut. The two rollers 20 and the belt 21 can eventually be replaced by a single roller as has been indicated schematically in FIG. 1.

Figure 2B:
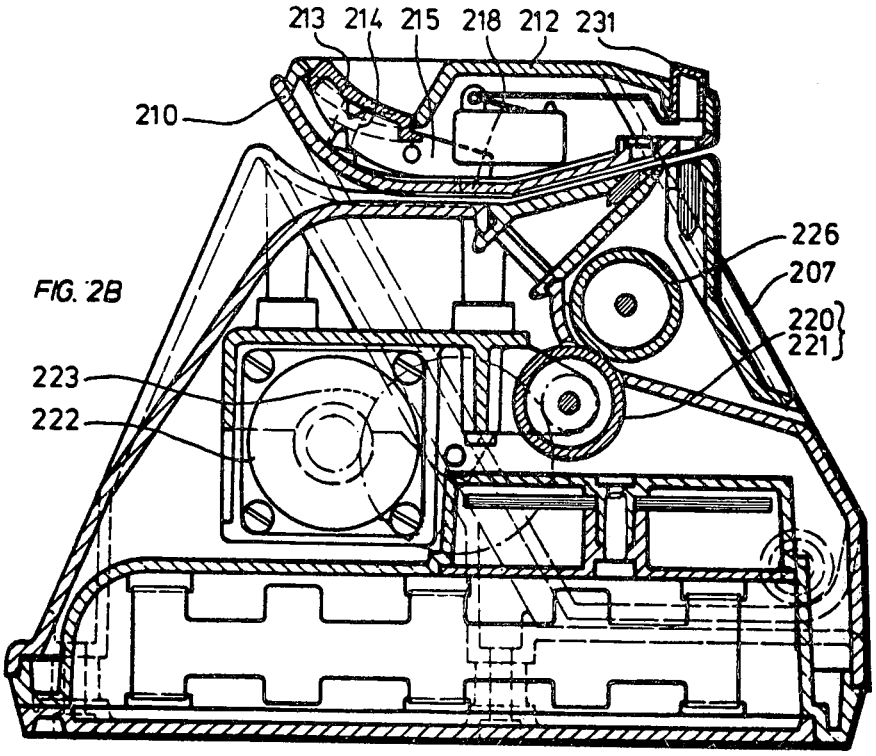
Figure 7:
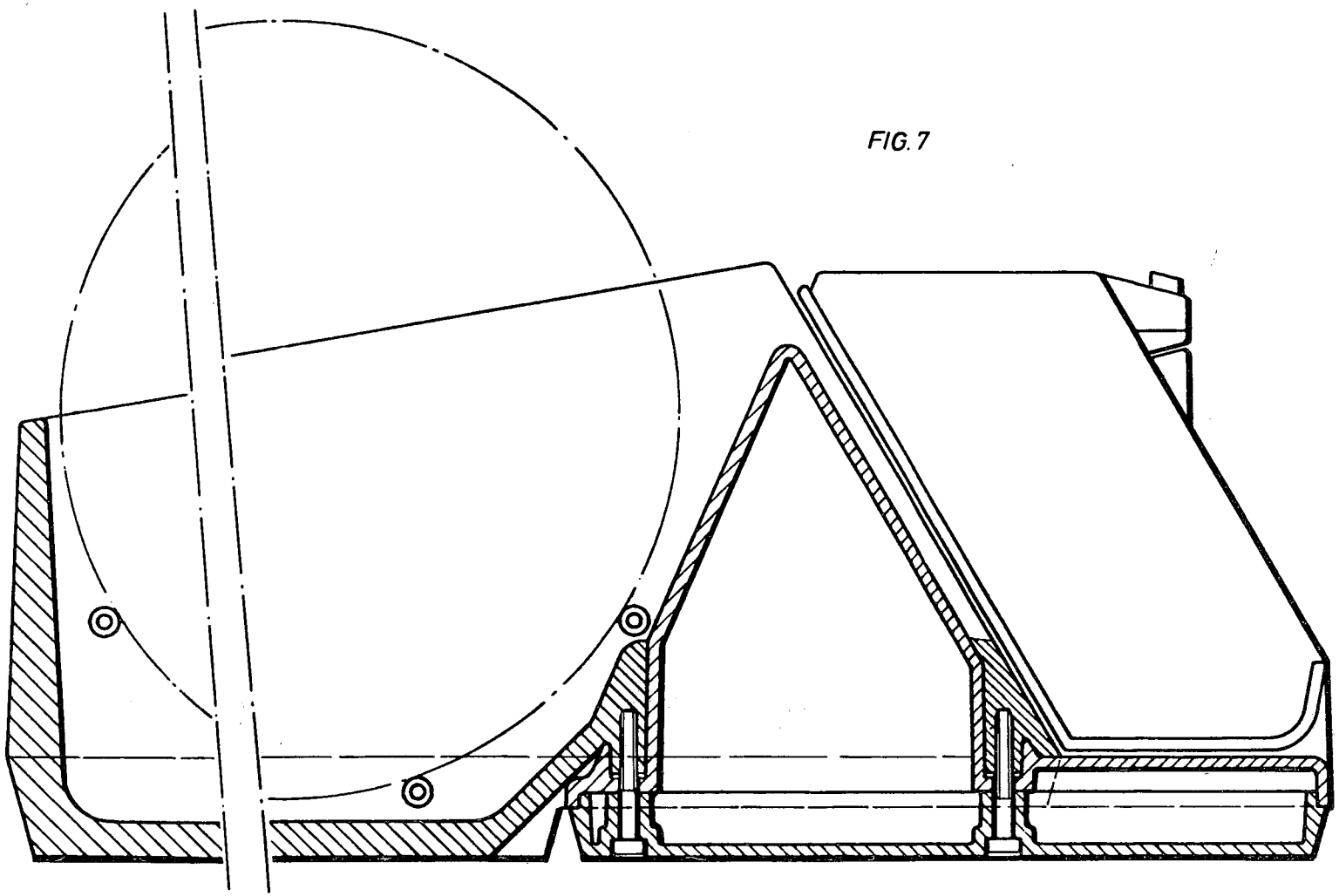
FIG. 7 is a partially sectional view of another embodiment in accordance with the invention consisting of a separate reel holder with motor driven front.

FIG. 2B shows another embodiment of the invention. In the Figure is only indicated by numbers those parts which are essentially designed in a different way compared to FIG. 2A, whereas the holder for the reel 6 in FIG. 2A is not shown due to the fact in the embodiment of FIG. 2B the reel holder is designed as a separate part which can be easily attached to the main part as shown in FIG. 2B. In FIG. 7 is shown, the partially sectional view of the embodiment as shown in FIG. 2B, in combination with the reel holder. Different reel holders can be attached of different sizes and different shapes.

The lid 212 in FIG. 2B is quite different from the lid 12 in FIG. 2A, also due to the fact that the push-button 213, which can be pressed against the action of a spring 214, which push-button 213 is fastened to two arms 215, which also has the locking part 218.

Also is shown in FIG. 2B that the roller 226 corresponds to roller 26 in FIG. 2A, whereas roller 25 in FIG. 2A has been eliminated. Also has been eliminated the two rollers 20 and belt rope 21 of FIG. 2A, due to the fact that these have been substituted by roller 220, 221 in FIG. 2B. Roller 220, 221 is driven by motor 222 through the intermediary of a transmission mechanism 223.

As can be seen from the FIGS. 2A and 2B the compartment for the batteries has also a different shape in the embodiment as shown in FIG. 2B.

The control-member of the device embodying the invention will be described in further detail with reference to FIG. 5.

Figure 5:
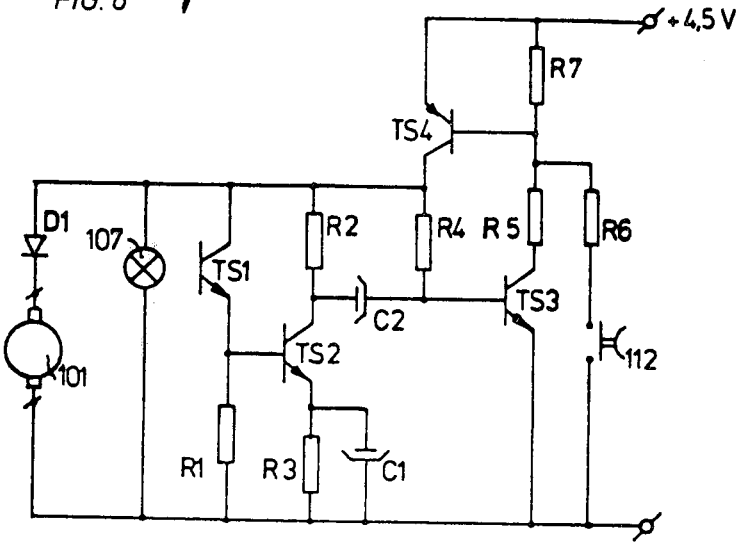
FIG. 5 illustrates the electronic design of the control-member of the device embodying the invention together with the photo-electric scanning members, a push-button for starting the device and part of the driving member.

The circuitry shown in FIG. 5, constituting a practical embodiment of the control-member 110 of FIG. 1, comprises mainly an amplifier formed by the transistor TS2, the resistors $R_1$, $R_2$ and $R_3$ and the capacitors $C_1$ and $C_2$. This amplifier controls a bistable circuit of transistors TS3 and TS4 and resistors $R_4$, $R_5$ and $R_7$. The amplifier transistor TS2 is controlled by means of a photo-transistor TS1 receiving light from the light source 107, for example, an incandescent lamp. The bistable circuit (TS4, TS3) is set (both transistors are enabled) by depressing the push-button 112 so that the base of transistor TS4 is grounded through $R_6$, The base setting voltage thus becoming positive and the transistor TS4 becoming conductive so that also TS3 becomes conducting because a base current is applied to TS3 via the resistor $R_4$.

In the rest position, that is to say, when the motor is not running, TS3 and TS4 are not conducting and no current is taken from the supply source, which is a specific property of the control-member in accordance with the present invention.

When push-button 112 is depressed, TS4 and hence TS3 become conducting and the bistable circuit TS3, TS4 changes over to the on-state.

The bistable circuit can be disabled by applying a negative pulse to the base of TS3 or a positive pulse to the base of TS4. In the present embodiment a negative pulse to the base of TS3 is chosen. This negative pulse appears when the photo-transistor TS1 receives more light. The direct-durrent amplification and hence the level of the output pulse of TS2 are determined by the ratio between the resistors $R_2$ and $R_3$. With a low amplification factor transistors TS1 and TS2 may be exchanged for other types without any objection. According to the invention the amplifier (TS2) is adjusted so that at a decrease in the quantity of light incident to the pick-up element of the photo-electric scanner during the passage of the material to be scanned beyond the scanner the output signal of the amplifier is not varied. In the embodiment shown in FIG. 5 this is achieved by providing such a value for resistor $R_1$ that at a partial darkening of the photo-transistor TS1 (that is to say when the adhesive labels are passing) the collector voltage of transistor TS2 is approximately equal to the supply voltage (for example 4.5 V, see FIG. 5). The transition to a lower light intensity occurring with a printed adhesive label will then not affect the collector voltage of transistor TS2. It is thus also possible to choose an adjustment such that at the transition to a higher light intensity (the transition from the adhesive label to the substrate) said signal is completely amplified by TS2. The emitter of transistor TS2 is at least partially A.C. discoupled by the electrolytic capacitor $C_1$ so that the amplification of the transitions is important.

The negative pulses for disabling the circuitry are applied via the electrolytic capacitor $C_2$, serving as a separation capacitor, to the base of transistor TS3.

An advantageous feature of the circuit arrangement shown in FIG. 5 is that in the rest state the supply source is not loaded, which is particularly important in the case of battery-driven devices. According to the invention this is achieved by feeding the amplifier (TS2), the photo-electric scanner (light source 107 and photo-transistor TS1) and the driving member across one of the transistors (TS4) of the bistable circuit. In accordance with the invention this advantage is further enhanced by designing the bistable circuit so that the two transistors (TS4 and TS3) are conducting in one state and non-conducting in the other state. A further advantageous feature of the control-arrangement resides in that the transistors are exchangeable so that any type of transistor may be used without further modifications.

The device embodying the invention has a further advantage in that a minimum number of mechanical components is employed by using a bistable circuit as a holding element so that the lifetime is very long. It should furthermore be noted that the control-arrangement is very simple of structure, so that it can be manufactured economically and may be accommodated in a small space.

It should be noted that the transistors indicated in the arrangement may, of course, be replaced by transistors of the opposite conductivity type. A diode D1 is employed for suppressing a reaction of inductive load when the device is switched out, which load might again enable the bistable circuit.

Figure 6:
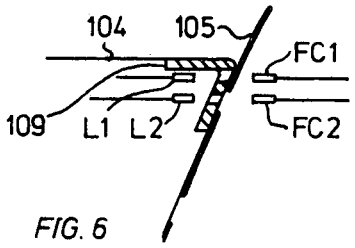
FIG. 6 illustrates an alternative embodiment of the photo-electric scanning members.

In FIG. 6 there has been indicated an alternative embodiment of the photo-electric scanning members. The photo-electric cell FC2 and the lamp L2 substantially correspond with the lamp 107 and the photo transistor TS1 in FIG. 5. The operation of the photo-electric cell FC1 and the lamp L1 substantially correspond with the operation of the push-button 112 and in FIG. 5. In this embodiment the control-member functions to stop the motor when there is a transition from dark to light at the photo-electric cell FC2 and starts the motor when there is a transition from dark to light at the photo-electric cell FC1. In the situation depicted in FIG. 6 the photo-electric FC1 is illuminated when the piece of material 105 is picked from the support 104, whereby the motor starts and the following piece of material is transported until again the situation indicated in FIG. 6 is obtained, in which situation the motor is stopped.

This embodiment has the advantage that the operator has not to, operate the push-button 112 each time he wants to pick off a piece of material. This embodiment is especially suitable for industrial applications, whereas the embodiment illustrated in FIG. 5 is more suitable for application in, for example, shops.

Figure 8:
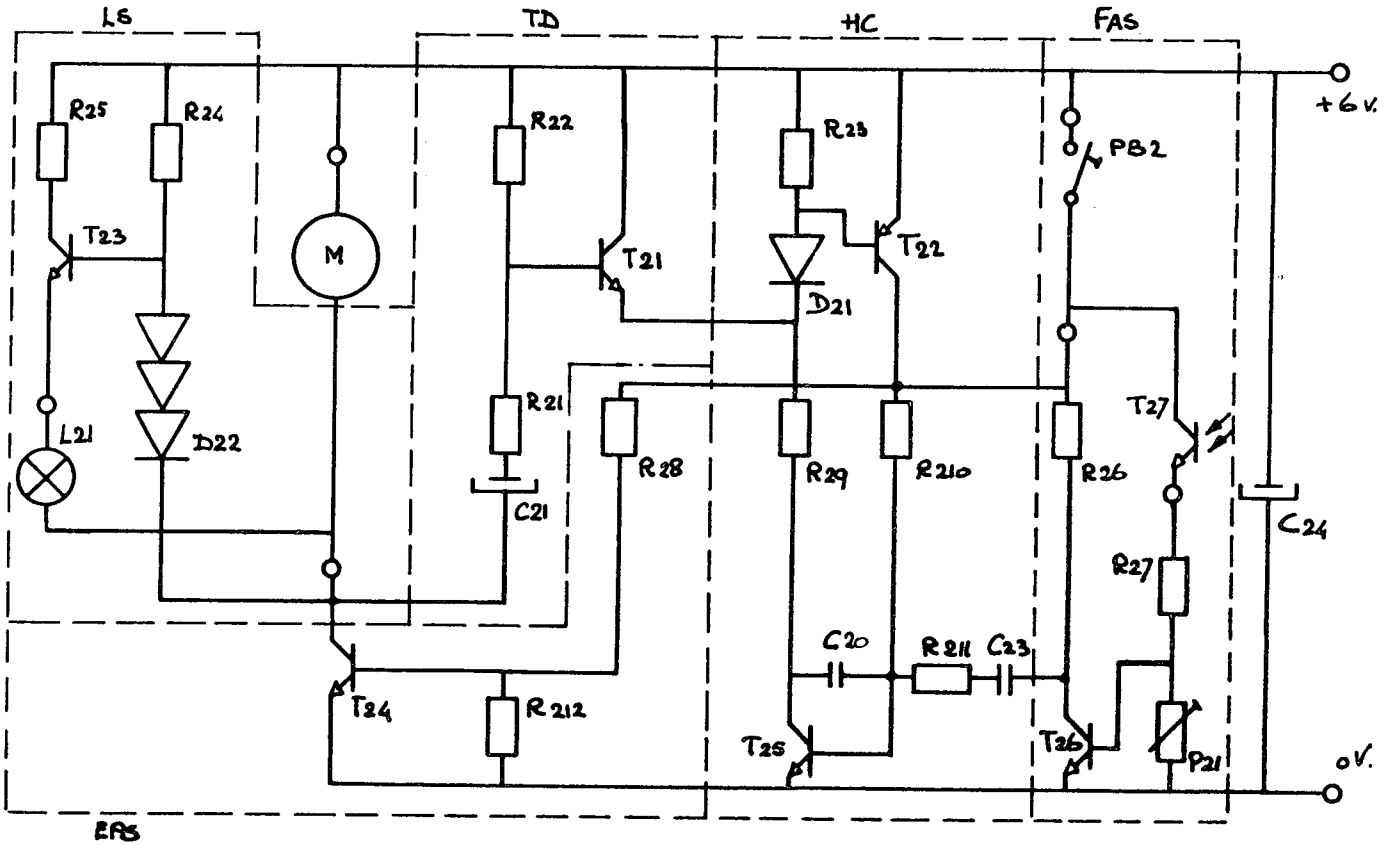
FIG. 8 shows an alternative embodiment for the circuit indicated in FIG. 5.

FIG. 8 shows an alternative embodiment of the electronic control device which is used in the device according to the invention.

As indicated in FIG. 8 the electronic control device essentially consists out of a photocell amplifier and switch FAS, a holding circuit HC, a time delay circuit TD, an electronic power switch EPS, and a lamp stabilizing circuit LS.

The photo amplifier and switch circuit contains a push button PB2 a photo transistor T27 the collector of which is connected to one side of the push button PB2 and to one side of the resistor R26 and the emitter of which is connected to the resistor R27. The photo transistor amplifier and switch further contains a transistor T26 and a potentiometer P21. The collector of the transistor T26 is connected to the other side of the resistor R26 and to the capacitor C23. The emitter of the transistor T26 is grounded and the base thereof is connected to the junction of the resistor R27 and the potentiometer P21.

C24 is a filter capacitor for the supply voltage.

The holding circuit HC contains a transistor T22 the emitter of which is connected to the positive supply voltage and the collector of which is connected to the junction of the resistor R210 and R26. The base of the transistor is connected to the anode of the diode D21 and one side of the resistor R23 the other side of which is at positive supply voltage. The holding circuit HC further contains the transistor T25 the emitter of which is grounded and the collector of which is connected to the resistor R29. The base of the transistor T25 is connected to the other side of the resistor R210. There is a capacitor C20 across the collector base circuit of the transistor T25. The holding circuit HC further has an input circuit connected to the base of the transistor T25 and comprising the resistor R211 and capacitor C23. This input circuit is connected to the collector of the transistor T26 of the photo amplifier and switch circuit FAS.

The time delay circuit contains the resistors R22, R21, the capacitor C21 and the transistor T21. From The transistor T21 the collector is connected to the positive supply voltage and the emitter is connected to the junction of the cathode of the diode D21 and the resistor R29. The base of the transistor T21 is connected to the junction of the resistor R21 and the resistor R22 the other side of which is at positive supply voltage. The time delay circuit TD further contains the electrolytic capacitor C21 one side of which is connected to the other side of the resistor R21 and the other side of which is connected to the junction of the collector of the transistor T24, one terminal of the motor M and the cathode of the diode D22.

The electronic power switch contains the transistor T24, the resistor R212 and the base resistor R28, which serves as an input resistor for the electronic power switch EPS. The collector of the transistor T24 is connected to the junction of the capacitor C21, the motor M, the diode D22 and the lamp L21. The emitter of the transistor T24 is grounded. The base of the transistor T24 is connected to the junction of the resistor R212, the other side of which is grounded and the resistor R28, the other terminal of which is connected to the junction of the collector of the transistor T22, one terminal of the resistor R210, the collector of the phototransistor T27, one terminal of the push button PB2 and one terminal of the resistor R26.

The lamp stabilizing circuit LS comprises a transistor T23, the lamp 21, the diode D22, the resistor R25 and the resistor R24. The collector of the transistor is connected to the resistor R25, the other terminal of which is at positive supply voltage. The emitter of the transistor T23 feeds the lamp L21, the other side of which is connected to the collector of the transistor T24 in the electronic power switch EPS. The base of the transistor T23 is connected to the junction of the resistor R24, the other side of which is at positive supply voltage and the anode of the diode D22, the cathode of which is connected to the collector of the transistor T24 in the electronic power switch EPS. The motor M is connected between the positive supply terminal and the collector of the transistor T24 in the electronic power switch EPS.

The electronic circuit according to FIG. 8 functions as follows. If in the situation indicated in FIG. 1, wherein the gap between two stickers 105 on the substrate 104 faces the lamp 107 and the photocell 106, the push button PB2 is tipped, then the transistor T25 in the holding circuit HC will conduct and also will the transistor T22 because of the positive feedback and loop gain greater than one in the amplifier loop comprised by the transistors T22 and T25. If the push button PB2 is released again the holding circuit HC will hold its state wherein both transistors T22 and T25 are conducting. Since the transistor T22 is conducting the transistor T24 in the electronic power switch EPS will also conduct whereby the motor and the lamp will be connected to ground via the transistor T24. The substrate will be driven by the motor M until the photo transistor T27 again detects the gap between two stickers on the substrate. This will cause the photo transistor T27 to conduct, whereby the transistor T26 starts to conduct too, taking away the base current for the transistor T25, whereby the holding circuit HC is switched of, so that both transistors T22 and T25 are in the non-conducting state. This again causes the transistor T24 to be switched of, so that the motor M is stopped and also the supply current for the lamp L21 is interrupted. The substrate 104 with the stickers 105 on it has now moved a distance which corresponds with the distance between two gaps between two stickers 105, so that the next sticker 105 can be taken off from the substrate 104.

The holding circuit HC comprises the capacitor C20 between the collector and the basis of the transistor T25 to prevent that short spikes will switch the holding circuit. In the input circuit of the holding circuit there is a capacitor C23 in series with the resistor R211, which prevents that slow transients would switch the holding circuit. Compared with FIG. 5 the holding circuit HC also comprises a diode D21, which serves to form a proper threshold for the holding circuit HC to switch from one state to another or when the time delay circuit TD has to switch off the motor M.

The potentiometer P21 is present in the photocell amplifier and switching circuit FAS to provide a possibility to adjust for different lamps, that is to say different light fluxes and different photo transistor parameters.

Compared with FIG. 5 there has also been introduced a time delay circuit TD. By means of this time delay circuit TD there can be adjusted a proper time period after which the motor will be stopped after having been started by means of the push button PB2. This is a very useful feature of this embodiment of the device according to the invention whereby failures in case of defects of the photo transistor or the lamp or eventually caused by wrapping of the substrate 104 can be prevented.

Compared with the embodiment according to FIG. 5 the embodiment according to FIG. 8 also shows the advantage of having a lamp stabilizing circuit LS. It should be remarked in connection with the lamp stabilizing circuit LS that the diode D22 in fact is a zener diode comprising a series circuit of three diodes.

Figure 9:
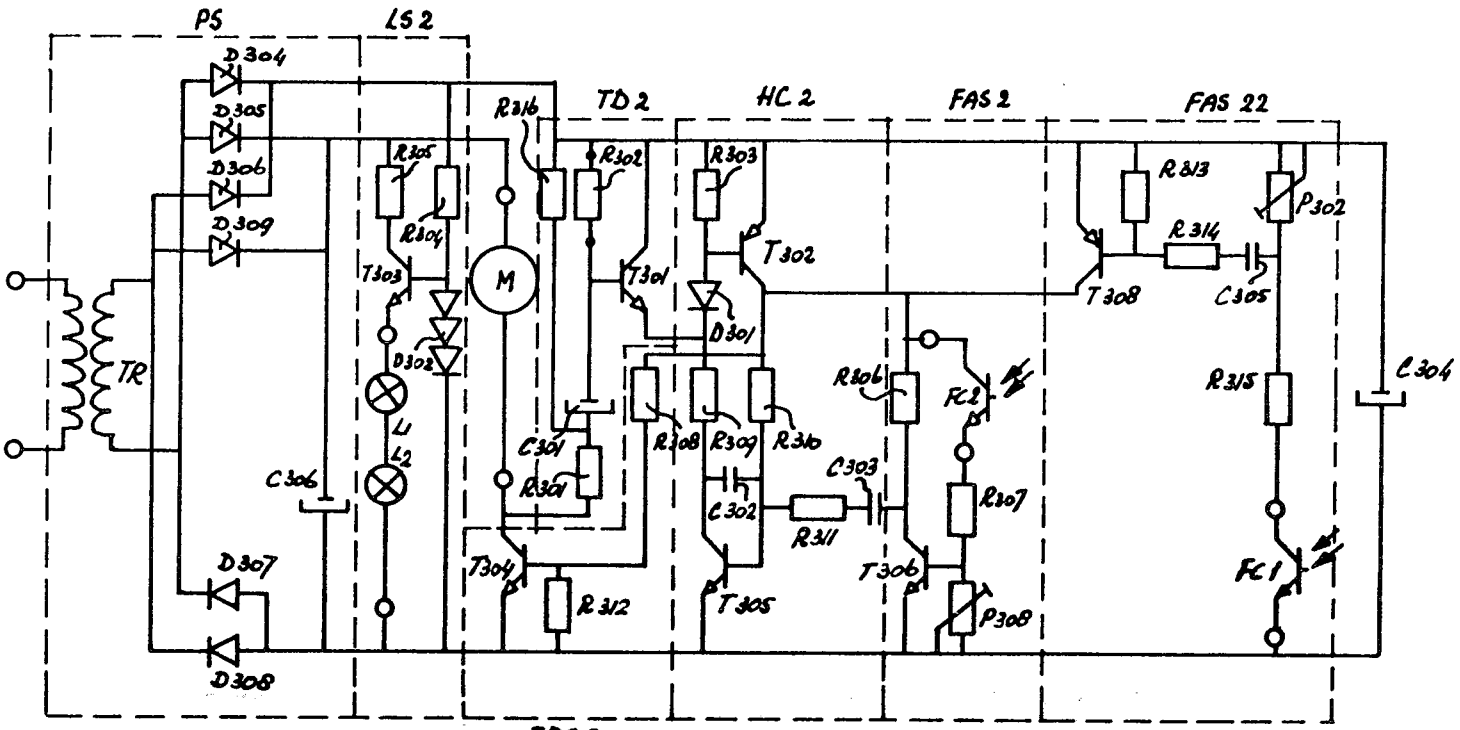
FIG. 9 shows a circuit, which is an alternative embodiment of the circuit according to FIG. 5 which is used with the positioning of the lamps and the photo-cells indicated in FIG. 6.

FIG. 9 describes another embodiment of the electronic control circuit, which can be used with the assembly of two photocells and two lamps as indicated in FIG. 6. The embodiment according to FIG. 9 very much corresponds with the embodiment according to FIG. 8. The main differences are that the push button PB2 in the embodiment according to FIG. 8 has been replaced by a photo electric switch FAS22 in the embodiment indicated in FIG. 9, that the electronic control circuit according to FIG. 9 is supplied from line voltage instead of from a battery as the circuit according to FIG. 8 is and that in the embodiment according to FIG. 9 there actually are two DC supply voltages.

The photo transistor amplifier and switch FAS2 in the embodiment according to FIG. 9 corresponds with the photocell amplifier and switch FAS in FIG 8, except for that the push button PB2 in the embodiment according to FIG. 8 has been replaced by a photocell amplifier and switch FAS22 in the embodiment according to FIG. 9. In the situation indicated in FIG. 6 the holding circuit HC2 in FIG. 9 exactly corresponds with the holding circuit HC in FIG. 8. The time delay circuit TD2 in FIG. 9 substantially corresponds with the time delay circuit TD in FIG. 8 except for that a resistor R316 has been added to prevent that an overvoltage from an unloaded transformer TR would damage the transistor T301. The lamp stabilizing circuit LS2 substantially corresponds with the lamp stabilizing circuit LS in FIG. 8. The difference is that this lamp stabilizing circuit LS2 in FIG. 9 has two different supply voltages and that the current for two series connected lamps L1 and L2 is supplied by the transistor T303, the lamp L2 being grounded.

The electronic power switch EPS2 in the embodiment according to FIG. 9 exactly corresponds with the electronic power switch EPS in the embodiment according to FIG. 8.

Instead of being supplied from a DC supply source as in the embodiment according to FIG. 8 the embodiment according to FIG. 9 is supplied from line voltage. Line voltage is connected to the transformer TR in the power supply PS, which transforms down the DC line voltage to a voltage suitable to operate the electronic control circuit connected thereto. The power supply PS further contains a double rectifying bridge, from which two diodes have been deleted, for supplying two separate DC voltages. This rectifying bridge contains the diodes D304, D305, D306, D307, D308 and D309. The power supply further contains an electrolytic capacitor C306 across a first output of the power supply PS and a second electrolytic capacitor C304 connected across a low ripple second output of the power supply PS.

The power supply PS has two outputs, one of which feeds the lamps L1 and L2 and the motor and the other of which feeds the rest of the electronic control circuit. This has the advantage that in fact the power supply has been split up into two sections, one of which is rather heavily loaded and besides that it is alternating heavily loaded and not loaded at all, and a section which is relatively light loaded and needs a relatively constant supply current and supply voltage. A further advantage obtained hereby is that the electrolytic capacitors C306 and C304 can be far small than they should be otherwise.

Now the function of the embodiment depicted in FIG. 9 will be described. The photocell FC1 will be dark and the photocell FC2 will be illuminated by the lamp L2. If now the sticker 105 is removed from the substrate 104 the photo transistor FC1 will be illuminated by the lamp 105, whereby in figure 9 the photo transistor FC1 will conduct instantaneously, whereby the transistor T308 will also conduct for a short moment determined by the capacitor C305 and the resistor R314. The shortly conducting transistor T308 will switch on the transistor T305 and the transistor T302, whereby the transistor T304 will be conducting too, so that the motor M is started. The motor M will run until the photocell FC2 is again illuminated by the lamp L2, whereby in FIG. 9 the photo transistor FC2 will conduct, whereby the transistors T302 and T305 are switched off and the motor is stopped again in the position indicated in FIG. 6.

The embodiment indicated in FIG. 9 further has the same advantages as has been described in connection with the embodiment according to FIG. 8.

The lamp circuit LS2 further shows the difference that the lamps L1 and L2 are directly connected to the power supply return line. As will be clear this is an advantage in this embodiment.

Figure 10:
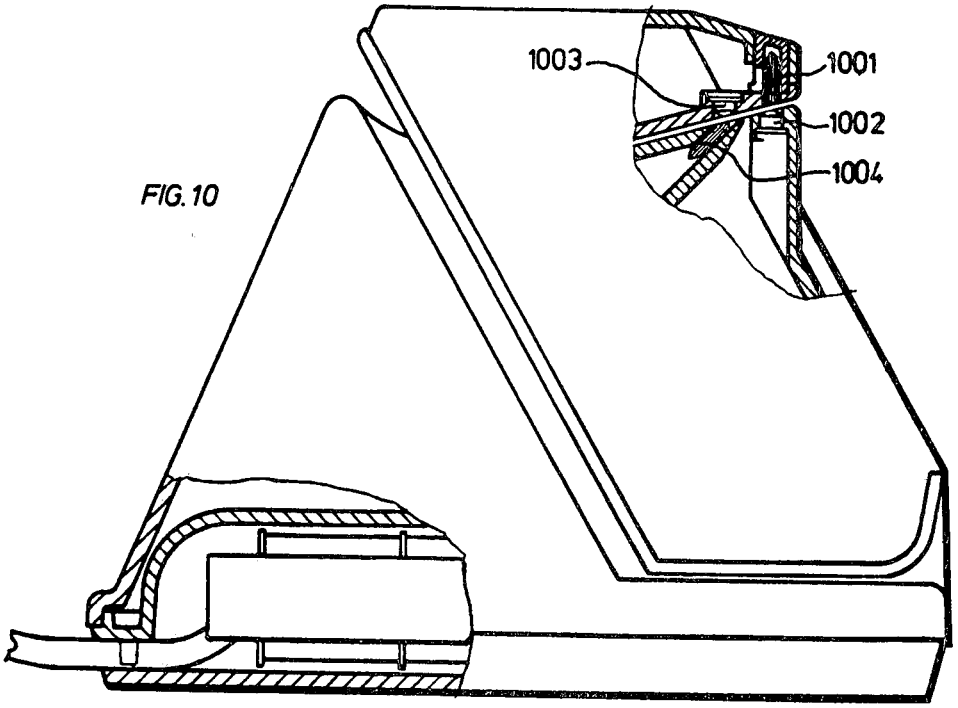
FIG. 10 shows a side view of the embodiment partially in section, of the front end of the device according to the invention.

FIG. 10 now shows the assembly of the photocells FC1 and FC2 and of the lamps L1 and L2 in a practical embodiment.

The reference number 1003 indicates the photocell FC2 and the reference number 104 indicates the lamp L2. The reference number 1001 indicates the lamp L1 and the reference number 1002 indicates the photocell FC2. It is obvious that the lamp 1001 can be mounted at the position for the photocell 102 and the photocell 102 can be mounted in the room for the lamp 101. This is also valid for the photocell 1003 and the lamp 1004.

I claim:

1. A device for removing adhesive labels or the like from a substrate comprising:
   - a reel on which said substrate is wound;
   - means for mounting said reel for rotation about an axis of rotation;
   - a housing having a trough in which said reel is mounted with an open upper end, said housing including a horizontal guide having a horizontal surface for supporting said substrate situated at a level higher than said axis of rotation, and a bending edge for the substrate at the end of said guide surface remote from said trough;
   - a light source disposed adjacent said bending edge;
   - driving means located below said guide surface for engaging said substrate to pull said substrate past said edge so as to separate one at a time said labels from said substrate;
   - a photo-electric cell disposed adjacent said bending edge for producing a given electrical signal indicating the presence of a separated label, when said label is located between said source and said cell; and
   - circuit means connected to said photo-electric cell for disabling said driving means when said given signal is produced.

2. A device as claimed in claim 1, wherein the substrate is made from light-pervious material.

3. A device as claimed in claim 1 wherein driving means comprises two rollers which co-operate in such a way that the substrate is urged between the two rollers.

4. A device as claimed in claim 1 further including a battery which serves as a supply source.

5. A device as claimed in claim 1 further including a second light source and a second photo-electric cell, mounted such that a label from the substrate first passes the first light source and the first photo-electric cell and that the control means operates to stop the driving member when the label passes the first photo-electric cell and to start the driving member when the label is released from the substrate.

6. A device as in claim 1 wherein said control means includes a holding circuit, an actuating means for bringing the holding circuit in a first state, amplifier means connected to said cell for bringing the holding circuit in a second state, the holding circuit in its first state actuating said driving means and said source for illuminating the cell and in its second state deactivating said driving means.

7. A device according to claim 1 wherein said control means includes time delay means for bringing the holding circuit back to its un-activating state after a predetermined period following when said holding circuit was brought to its activating state.

8. Control circuit for a device according to anyone of the preceding claims comprising a holding circuit means, a first photo transistor amplifying and switching means for bringing the holding circuit in an activating state, a second photo transistor amplifying and switching means for bringing the holding circuit means in a not-activating state, the holding circuit activating a mechanical transporting means and illumination means in its activating state, and comprising further means cooperating with the first photo transistor amplifying and switching means and the second photo transistor amplifying and switching means for bringing back the holding circuit means to its not-activating state in response upon the mechanical transporting means having transported a medium to be transported over a certain distance.

9. A device according to claim 8 further comprising a time delay means to bring the holding circuit means back to its not-activating state after a certain period of time has lapsed since the holding circuit means was brought in its activating state.

10. A device as claimed in claim 1 wherein said driving means comprises a pair of rollers, a third roller and an endless belt passed around said pair of rollers and adapted to co-operate with said third roller to urge the substrate against the belt.

11. A device as claimed in claim 10 wherein said pair of rollers are mounted in the housing and said third roller co-operating with the belt is journalled in a lid pivoted to the housing.

12. A device as claimed in claim 11 wherein the bending edge is formed by the end of a plate arranged in the housing, while a lid pivoted to the housing is provided with a plate extending parallel to the plate inside the housing so that the belt is passed between said two plates.

13. A device as claimed in claim 12 wherein near the bending edge the plate inside the housing has an opening beneath which a light source is provided, while above said opening said photo-electric cell is arranged in the plate forming part of the lid.

14. A device as claimed in claim 1 wherein said circuit means comprises an amplifier controlled by said photo-electric cell and in that the adjustment of the amplifier is such that at a decrease in the quantity of light incident to said cell during the passage of said label the output signal of the amplifier is not varied.

15. A device as claimed in claim 14 wherein said circuit means includes a bistable circuit, which is set into a first state from the outside and can be set in the other state by the input signal of the amplifier.

16. A device as claimed in claim 15 wherein said amplifier, the photo-electric cell and the driving means are connected to one of the transistors of the bistable circuit.

17. A device as claimed in claim 15 wherein the bistable circuit is designed so that two transistors are conducting in one state and non-conducting in the other state.

18. A device as claimed in claim 15 wherein the amplifier is fed back for direct current and is at least partly discoupled for alternating current.

* * * * *